US009370959B2

(12) United States Patent
Davies-Smith et al.

(10) Patent No.: US 9,370,959 B2
(45) Date of Patent: Jun. 21, 2016

(54) REFILL PLUG RELEASE ASSEMBLY AND WRITING INSTRUMENT COMPRISING SAME

(71) Applicant: Europe Brands S.à r.l., Luxembourg (LU)

(72) Inventors: Leighton Davies-Smith, Oak Ridge, NC (US); Jean-Patrick Dalancourt, St. Etienne de Montluc (FR)

(73) Assignee: Europe Brands S.à.r.l., Luxembourg (LU)

( * ) Notice: Subject to any disclaimer, the term of this patent is extended or adjusted under 35 U.S.C. 154(b) by 257 days.

(21) Appl. No.: 14/099,883

(22) Filed: Dec. 6, 2013

(65) Prior Publication Data

US 2014/0161508 A1 Jun. 12, 2014

Related U.S. Application Data

(60) Provisional application No. 61/734,118, filed on Dec. 6, 2012.

(51) Int. Cl.

| | |
|---|---|
| ***B43K 5/00*** | (2006.01) |
| ***B43K 11/00*** | (2006.01) |
| ***B43K 8/03*** | (2006.01) |

(52) U.S. Cl.
CPC .. *B43K 11/00* (2013.01); *B43K 8/03* (2013.01)

(58) Field of Classification Search
CPC ..... B43K 8/03; B43K 11/00
USPC ..... 401/109, 180
See application file for complete search history.

(56) References Cited

U.S. PATENT DOCUMENTS

| | | | | |
|---|---|---|---|---|
| 2,619,070 | A | 11/1952 | Baker | |
| 2,871,825 | A | 2/1959 | Uchida et al. | |
| 4,347,011 | A | 8/1982 | Yanagita | |
| 4,669,904 | A * | 6/1987 | Kageyama | B43K 24/084 401/109 |
| 5,290,117 | A | 3/1994 | Yokosuka et al. | |
| 8,550,735 | B2 * | 10/2013 | Rolion | B43K 17/005 401/103 |
| 2013/0064597 | A1 | 3/2013 | Davies-Smith et al. | |

FOREIGN PATENT DOCUMENTS

| | | | |
|---|---|---|---|
| DE | 19703853 | A1 | 8/1997 |
| EP | 1277595 | A1 | 1/2003 |
| EP | 1535753 | A1 | 6/2005 |
| FR | 577460 | A | 9/1924 |

(Continued)

OTHER PUBLICATIONS

International Preliminary Report on Patentability, corresponding international application No. PCT/US2013/073527, Jun. 9, 2015.
Communication Relating to the Results of the Partial International Search, corresponding International Application No. PCT/US2013/073527, dated Feb. 19, 2014.

(Continued)

*Primary Examiner* — Jennifer C Chiang
(74) *Attorney, Agent, or Firm* — Marshall, Gerstein & Borun LLP

(57) ABSTRACT

A writing instrument includes a barrel, a refill assembly, and a refill plug assembly that is quick to release from the barrel and quick to re-attach to the barrel when changing a refill assembly. The refill plug assembly is quickly secured to the barrel of the writing instrument and quickly released from the barrel of the writing instrument through a twisting and/or pushing action that may require less than one full turn to disengage from the barrel and to re-attach to the barrel, thus expediting replacement of the refill assembly.

20 Claims, 7 Drawing Sheets

(56) References Cited

FOREIGN PATENT DOCUMENTS

| | | | |
|---|---|---|---|
| GB | 194879 | A | 3/1923 |
| WO | WO-00/64688 | A1 | 11/2000 |
| WO | WO-2004/082963 | A1 | 9/2004 |
| WO | WO-2008/007167 | A1 | 1/2008 |

OTHER PUBLICATIONS

International Search Report and Written Opinion, International Application No. PCT/US2013/073527, mailing date May 22, 2014.

* cited by examiner

REFILL PLUG RELEASE ASSEMBLY AND WRITING INSTRUMENT COMPRISING SAME

BACKGROUND

1. Field of the Invention

The invention generally relates to a refill plug assembly for accessing a refill assembly of a writing instrument and more specifically to a refill plug assembly that is quickly secured to the barrel of the writing instrument and quickly released from the barrel of the writing instrument through a twisting and/or pushing action.

2. Related Technology

Some conventional writing instruments have a replaceable refill assembly for replacing ink when ink in one refill assembly is depleted. Typically, the refill assembly is longitudinally disposed within a hollow center of a barrel of the writing instrument. The hollow center of the barrel may be accessed by removing a front portion (or ferrule portion) of the writing instrument, or the hollow center portion may be accessed by removing a cap on an end of the barrel opposite the writing point. The refill assemblies may include an ink reservoir and a writing point that is fluidly connected to the ink reservoir so that replacing the refill assembly also includes replacing the writing point. Other refill assemblies may not include a writing point and such refill assemblies may be fluidly connected to the writing point during insertion of the refill assembly into the barrel.

When accessing the hollow portion of the barrel, from either end, the cap or the ferrule is typically attached to the barrel with a threaded connection. To remove the cap or the ferrule, the cap or the ferrule must be rotated through several complete turns before the threads disengage. As a result, changing the refill assembly is time consuming because removing the ferrule or the cap and re-attaching the ferrule and cap are both time consuming operations.

SUMMARY

A writing instrument includes a barrel and a refill plug assembly that is quickly released from the barrel and quickly re-attached to the barrel when changing a refill assembly. In one embodiment, the refill plug assembly requires less than one full turn to disengage from the barrel and to re-attach to the barrel, thus expediting replacement of the refill assembly.

In another embodiment, a refill plug assembly includes a button having a button first end, a button second end, and a hollow bore, the hollow bore having an opening proximate the second button end. A sheath is operatively connected to the button, the sheath having a first sheath end, a second sheath end, a through-bore, and external turn threads disposed on an outer surface proximate the first sheath end. A plunger is slidably disposed within the through-bore of the sheath.

In another embodiment, a refill plug assembly includes a button having a button first end, a button second end, and a hollow bore, the hollow bore having an opening proximate the second button end. A sheath is operatively connected to the button, the sheath having a first sheath end, a second sheath end, and a through-bore. A plunger is slidably disposed within the through-bore of the sheath so that the plunger is displaceable between a first extended position in which a first plunger end is proximate the second sheath end and a second retracted position in which the first plunger end is proximate the button second end. One or more posts extend outward from the sheath, the posts being sized and shaped to cooperate with a cam channel on a cam liner to releasably secure the refill plug assembly to a barrel of a writing instrument.

In yet another embodiment, a refill plug assembly includes a button having a button first end, a button second end, and a hollow bore, the hollow bore having an opening proximate the second button end. A sheath is operatively connected to the button, the sheath having a first sheath end, a second sheath end, and a through-bore. A plunger is slidably disposed within the through-bore of the sheath so that the plunger is displaceable between a first extended position in which a first plunger end is proximate the second sheath end and a second retracted position in which the first plunger end is proximate the button second end. One or more posts extend radially outward from a free end of a flexible arm on the sheath. The flexible arm is disposed between two legs of a channel and the one or more posts cooperate with a cam groove on a cam liner to releasably secure the refill plug assembly to a barrel of a writing instrument.

In another embodiment, a writing instrument having a refill plug assembly includes a barrel having a hollow central bore. A refill assembly including an ink reservoir that is fluidly connected to a writing point is removably disposed within the hollow central bore of the barrel. A refill plug assembly is disposed at one end of the hollow central bore, the refill plug assembly including a button having a first button end, a second button end, and a hollow bore, the hollow bore having an opening proximate the second button end. A sheath is operatively connected to the button, the sheath having a first sheath end, a second sheath end, and a through-bore, and a plunger is slidably disposed within the through-bore of the sheath so that the plunger is displaceable between a first extended position in which a first plunger end is proximate the second sheath end and a second retracted position in which the first plunger end is proximate the button second end.

BRIEF DESCRIPTION OF THE DRAWINGS

Further features and advantages of the invention can be gathered from the claims, the following description, and the attached diagrammatic drawings, wherein:

DETAILED DESCRIPTION

Figure 1:
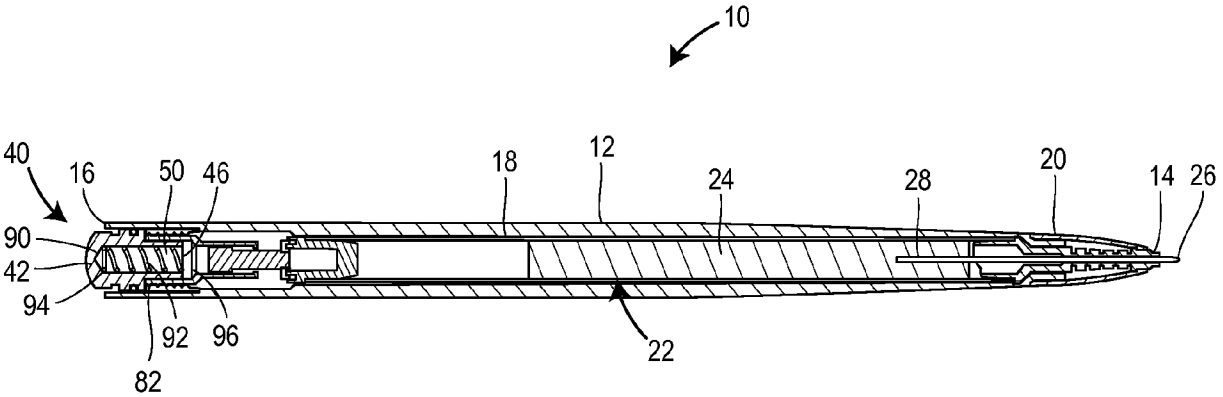
FIG. 1 is a longitudinal cross-sectional view of a writing instrument with a refill plug assembly.
Figure 2:
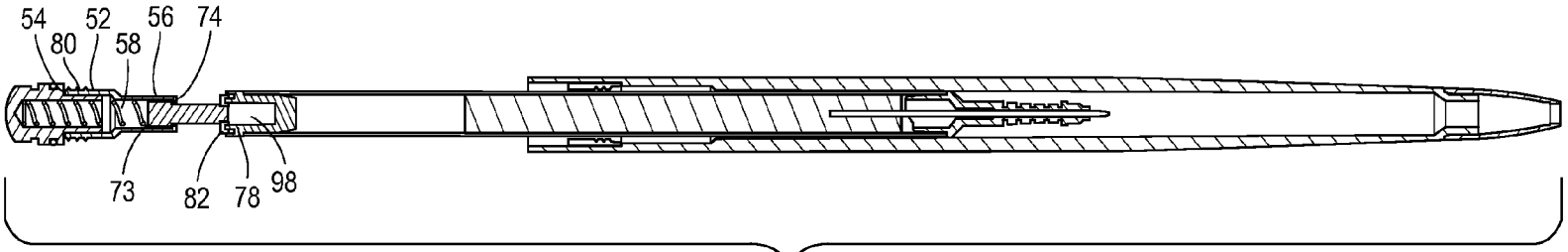
FIG. 2 is a longitudinal cross-sectional view of the writing instrument of FIG. 1 with the refill plug assembly and a refill assembly partially removed from a barrel of the writing instrument.
Figure 3:
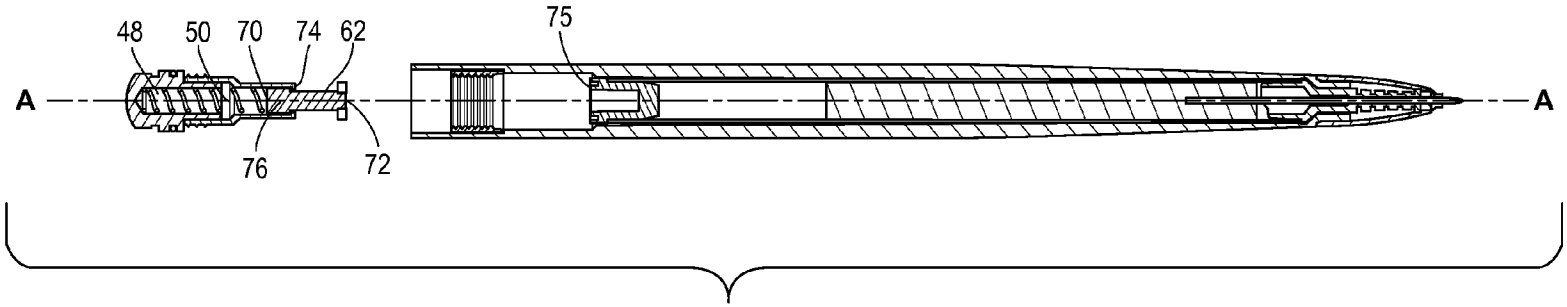
FIG. 3 is a longitudinal cross-sectional view of the writing instrument of FIG. 1 with the refill plug assembly removed from the barrel.

The disclosed refill plug assembly allows a user quick and easy access to a hollow portion of a barrel for replacement of an ink refill assembly. The refill plug assembly may be releasably secured to the barrel with a connection that engages or disengages the barrel with a twist and/or a push of the refill plug assembly.

The writing instrument 10 exemplified in the drawings has a writing tip comprising an extruded plastic nib, however, other writing points including, but not limited to ball points, porous plastic nibs, fountain pen nibs, and felt tip pen nibs can be used. In addition to writing instruments, other fluid application devices could also be made in accordance with the teachings of the disclosure by selection of appropriate components.

Turning now to FIGS. 1-4, the writing instrument 10 includes a barrel 12 having a first barrel end 14, a second barrel end 16, and a hollow central bore 18. A ferrule section 20 may extend from the first barrel end 14. In some embodiments, the ferrule section 20 and the barrel 12 may be separate components; in others, the ferrule section 20 may be integrally formed with the barrel 12.

A refill assembly 22 may be disposed within the hollow central bore 18. The refill assembly 22 may include an ink reservoir 24 that is fluidly connected to a writing point 26. In some embodiments, an ink feedstick 28 may be fluidly connected to both the ink reservoir 24 and to the writing point 26 to facilitate delivery of ink from the ink reservoir 24 to the writing point 26. The ink feedstick 28 may be an extruded feedstick or a fibrous feedstick, for example. Alternatively, the ink reservoir 24 can be fluidly connected to the writing point 26 via a lumen. In some embodiments the ink reservoir 24 may be a fibrous reservoir and in other embodiments the ink reservoir 24 may be a free ink reservoir.

A refill plug assembly 40 may be releasably secured to the barrel 12 at the second barrel end 16. The refill plug assembly 40 prevents the ink refill assembly 22 from unintentionally becoming dislodged from the hollow central bore 18 and maintains the ink refill assembly 22 in its proper position within the barrel 12. The refill plug assembly 40 may be quickly and easily removed to access the ink refill assembly 22. For example, in one exemplary embodiment, the refill plug assembly 40 may be rotated through less than one full turn to release the refill plug assembly 40 from the barrel 12.

The refill plug assembly 40 may include a button 42, a sheath 52, and a plunger 62. The button 42 may have a first button end 44 and a second button end 46. The button 42 may also include a hollow bore 48 having an opening 50 proximate the second button end 46. The sheath 52 may include a first sheath end 54, a second sheath end 56, and a through bore 58. A first sheath portion 60 may be operatively connected to the button 42 and a second sheath portion 64 may extend away from the button 42. The first sheath portion 60 may have an inner diameter that is larger than an inner diameter of the second sheath portion 64. An angled portion 66 may connect the first sheath portion 60 to the second sheath portion 64.

The plunger 62 may be slidably attached to the second sheath portion 64. So that the plunger is displaceable between a first extended position in which a first body end 70 is proximate the second sheath end 56 and a second retracted position in which the first body end 70 is proximate the button second end 46. The plunger may include a plunger body 68 having the first body end 70 and a second body end 72. At least a portion of the plunger body 68 may be disposed within the through bore 58 of the sheath 52. The plunger body 68 may be displaceable longitudinally within the through bore 58 substantially parallel to a longitudinal axis A of the sheath 52. In some embodiments, the through bore 58 and the plunger body 68 may be substantially cylindrical in shape. In other embodiments, the through bore 58 and the plunger body 68 may take on other shapes as long as the plunger body 68 has a shape that fits within the through bore 58. In preferred embodiments, the plunger body 68 has an outer shape that is complimentary to the inner shape of the through bore 58.

The second portion 64 of the sheath 52 may include an inner annular flange 74 extending inwardly from an inner surface 73 of the through bore 58 proximate the first sheath end 56. The inner annular flange 74 may be sized and shaped to retain at least a portion of the plunger 62 within the through bore 58. Similarly, the plunger 62 may include an outer annular flange 76 proximate the first body end 70, the outer annular flange 76 being sized and shaped to retain the plunger 62 at least partially within the through bore 58. In one embodiment, the outer annular flange 76 may cooperate with the inner annular flange 74 to prevent the plunger 62 from moving completely out of the through bore 58. The inner annular flange 74 may act as a stop for the outer annular flange 76, thus preventing further longitudinal movement of the plunger 62 away from the sheath 52.

A retaining element 77 may be located proximate the second body end 72. The retaining element 77 may cooperate with the refill assembly 22 to releasably secure the plunger 62 to the refill assembly 22 to facilitate removal of the refill assembly 22 from the barrel 12. In one embodiment, the retaining element 77 may have the shape of an annular ring with an annular opening facing the refill assembly 22. The annular ring may be sized to releasably receive a portion of the refill assembly 22. More specifically, the annular ring may be sized to receive an annular wall 75 of the refill assembly 22 that may be formed at least in part by an annular channel 78.

In one embodiment the sheath 52 may include external threads 80 disposed on an outer surface of the first portion 60 of the sheath 52. The external threads 80 may cooperate with internal threads 82 disposed on an inner surface of the barrel 12 to releasably secure the refill plug assembly 40 in the barrel 12. The external threads 80 and the internal threads 82 may form a threaded connection that may be engaged or released with less than a full turn of the refill plug assembly 40. In some embodiments, the threaded connection may engage or release with approximately a ¼ turn of the refill plug assembly 40. For example, a first short thread that extends around a quarter of the circumference of the outer surface of the sheath 52 and a second short thread that extends around a quarter of the inner surface of the barrel 12 may cooperate to produce a threaded connection that releases and/or engages in approximately ¼ turn of the refill plug assembly 40. One of the first and second short threads may include a stopping surface or ridge at one end thereof to prevent the refill plug assembly 40 from turning more than approximately ¼ turn when the threads are engaged. In yet other embodiments, a bayonet connection may be used instead of a threaded connection.

Figure 4:
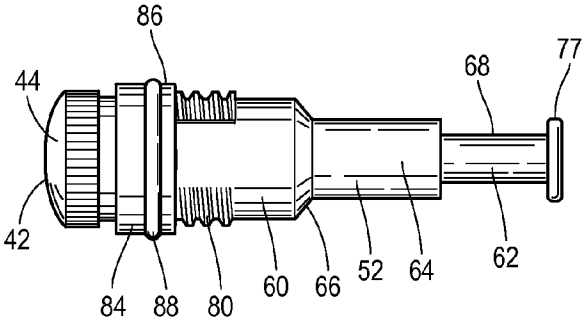
FIG. 4 is a side view of the refill plug assembly of the writing instrument of FIG. 1.
Figure 5:
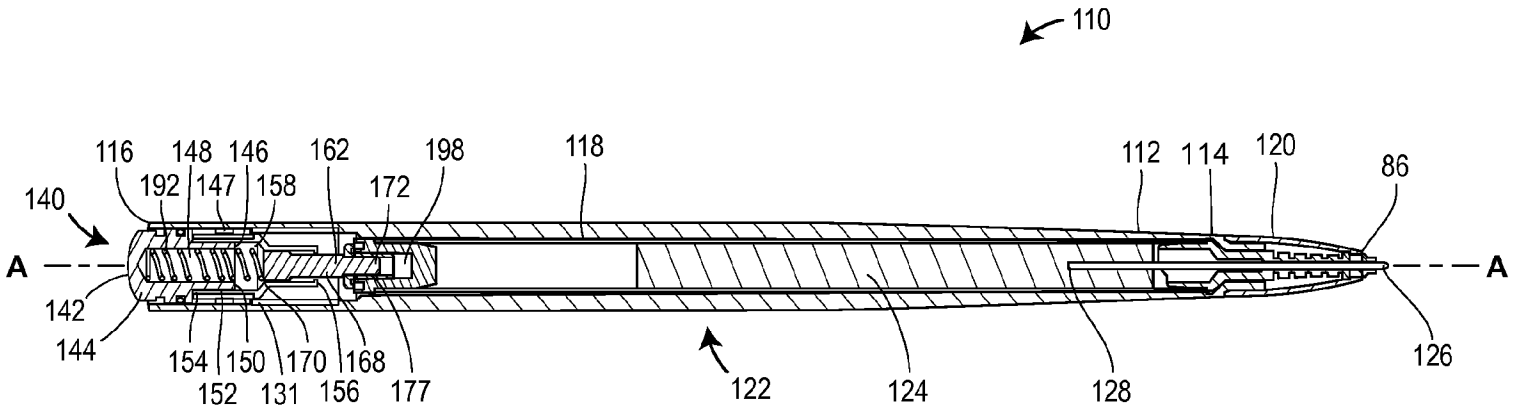
FIG. 5 is a longitudinal cross-sectional view of a writing instrument with an alternate embodiment of a refill plug assembly.

Turning now more specifically to FIG. 4, the button 42 includes an outwardly extending circumferential wall 84. The circumferential wall 84 includes an annular wall recess 86 that retains an annular ring 88. In one embodiment the annular ring 88 may be an elastomeric o-ring. When the refill plug assembly 40 is releasably secured to the barrel 12 proximate the first barrel end 16, the circumferential wall 84 and the annular ring 88 cooperate with an inner surface of the barrel 12 to seal the refill assembly 22 within the barrel 12 to protect the refill assembly 22 from environmental factors or damage.

A spring 92 (FIG. 1) is disposed within the refill plug assembly 40 to bias the refill plug assembly 40 away from the refill assembly 22, which facilitates removal of the refill plug assembly 40 when the refill assembly 22 is changed. More specifically, the spring 92 has a first spring end 94 and a second spring end 96. The first spring end 94 is seated against a tapered surface 90 in the hollow bore 48 of the button 42 and the second spring end 96 is seated against the plunger 62, thus biasing the plunger 62 away from the button 42.

When the refill plug assembly 40 is released from the barrel 12, the spring 92 causes the button 42 to move away from the plunger 62, which is releasably connected to the refill assembly 22. As the button 42 moves away from the plunger 62, the button 42 extends beyond the first barrel end 16, which makes the button 42 easy to grasp. A user then may pull the button 42 away from the first barrel end 16, which causes sheath 52 to slide away from the first barrel end 16 with the button 42 until the outer annular flange 76 on the plunger 62 engages the inner annular flange 74 on the sheath 52. Once the outer annular flange 76 engages the inner annular flange 74, any further movement of the button 42 away from the barrel 12 causes the refill assembly 22 to move with the refill plug assembly 40 because the retaining element 77 is releasably engaged with the refill assembly 22 via the annular wall 75.

When securing the refill plug assembly 40 to the barrel 12 after replacing the refill assembly 22, the refill plug assembly 40 is inserted at least partially into the hollow central bore 18 of the barrel 12. As the refill plug assembly 40 is moved into the hollow central bore 18, the retaining element 77 will eventually contact the refill assembly 22 and the retaining element will releasably engage the annular wall 75. As the refill plug assembly 40 continues to move into the hollow central bore 18, the spring 92 will keep the plunger 62 biased towards the refill assembly 22. The second end 72 of the plunger 62 is received at least partially by a blind bore 98 in the refill assembly 22. Eventually the second end 72 of the plunger 62 will bottom out in the blind bore 98. At that point, the first end 70 of the plunger 62 will slide within the second portion 64 of the sheath 52 as the bias produced by the spring 92 is overcome. Finally, the external threads 80 will engage the internal threads 82 and a turn of less than one complete revolution of the refill plug assembly 40 releasably secures the refill plug assembly 40 within the barrel 12.

A writing instrument 110 with a second embodiment of a refill plug assembly 140 is illustrated in FIGS. 5-12. Elements of the writing instrument 110 that are similar to the elements of the writing instrument 10 of FIGS. 1-4 are given similar reference numerals, but increased by 100.

The writing instrument 110 illustrated in FIGS. 5-12 includes a barrel 112 having a first barrel end 114, a second barrel end 116, and a hollow central bore 118. A ferrule section 120 may extend from the first barrel end 114. In some embodiments, the ferrule section 120 and the barrel 112 may be separate components; in others, the ferrule section 120 may be integrally formed with the barrel 112.

A refill assembly 122 may be disposed within the hollow central bore 118. The refill assembly 122 may include an ink reservoir 124 that is fluidly connected to a writing point 126. In some embodiments, an ink feedstick 128 may be fluidly connected to both the ink reservoir 124 and to the writing point 126 to facilitate delivery of ink from the ink reservoir 124 to the writing point 126. The ink feedstick 128 may be an extruded feedstick or a fibrous feedstick, for example. Alternatively, the ink reservoir 124 can be fluidly connected to the writing point 126 via a lumen. In some embodiments the ink reservoir 124 may be a fibrous reservoir and in other embodiments the ink reservoir 124 may be a free ink reservoir.

A refill plug assembly 140 may be releasably secured to the barrel 112 at the second barrel end 116. The refill plug assembly 140 prevents the ink refill assembly 122 from unintentionally becoming dislodged from the hollow central bore 118 and maintains the ink refill assembly 122 in its proper position within the barrel 112. The refill plug assembly 140 may be quickly and easily removed to access the ink refill assembly 122. For example, the refill plug assembly 140 may be rotated through less than one full turn (approximately ¼ turn) to release the refill plug assembly 140 from the barrel 112.

The refill plug assembly 140 may include a button 142, a sheath 152, and a plunger 162. The button 142 may have a first button end 144 and a second button end 146. The button 142 may also include a hollow bore 148 having an opening 150 proximate the second button end 146, similar to the embodiment of FIGS. 1-4.

Figure 6:
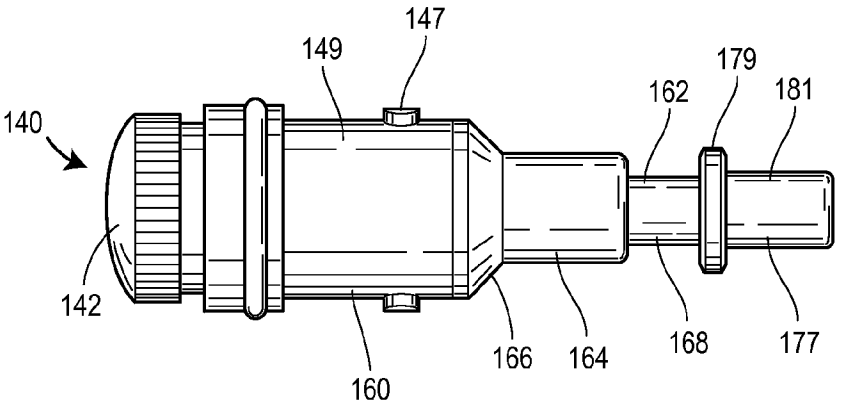
FIG. 6 is a side view of a button, a sheath, and a plunger of the refill plug assembly of the writing instrument of FIG. 5.
Figure 7:
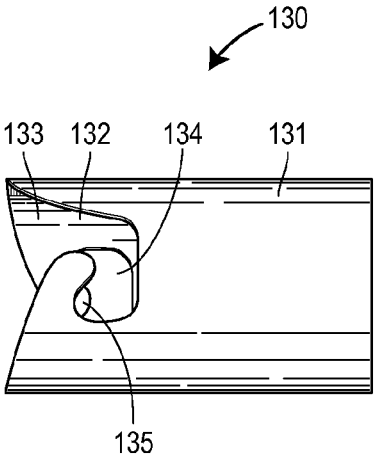
FIG. 7 is a side view of a liner of the refill plug assembly of the writing instrument of FIG. 5.
Figure 8:
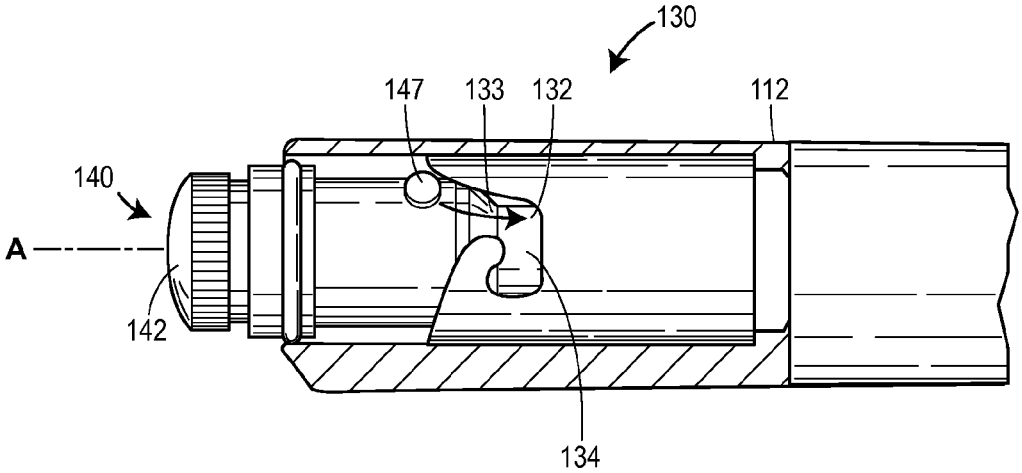
FIG. 8 is a close up view of the refill plug assembly of the writing instrument of FIG. 5 in an unlocked position with the barrel of the writing instrument being partially removed.
Figure 9:
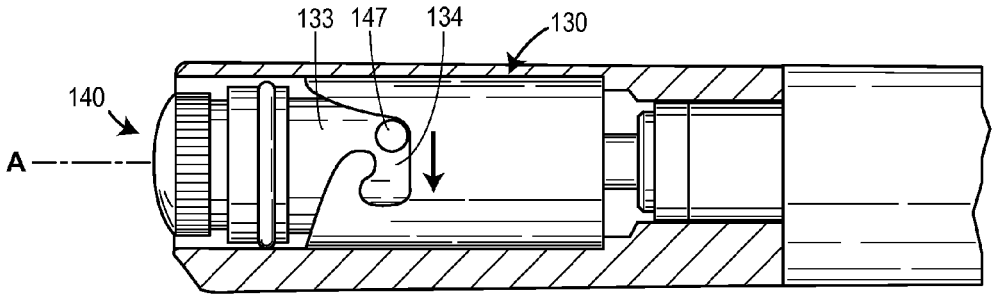
FIG. 9 is a close up view of the refill plug assembly of the writing instrument of FIG. 5 in a first intermediate position between an unlocked position and a locked position with the barrel of the writing instrument being partially removed.
Figure 10:
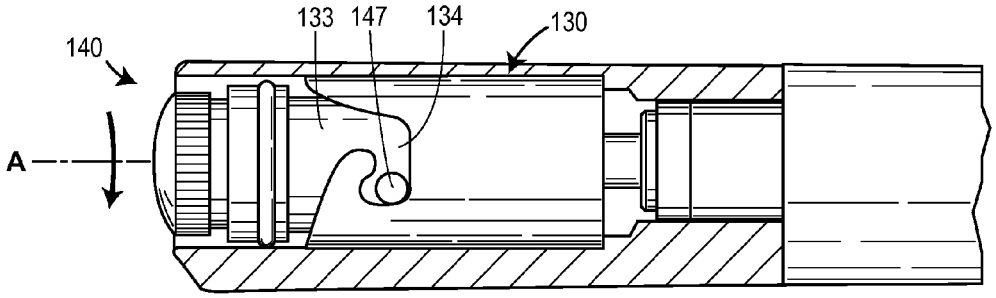
FIG. 10 is a close up view of the refill plug assembly of the writing instrument of FIG. 5 in a second intermediate position between an unlocked position and a locked position with the barrel of the writing instrument being partially removed.
Figure 11:
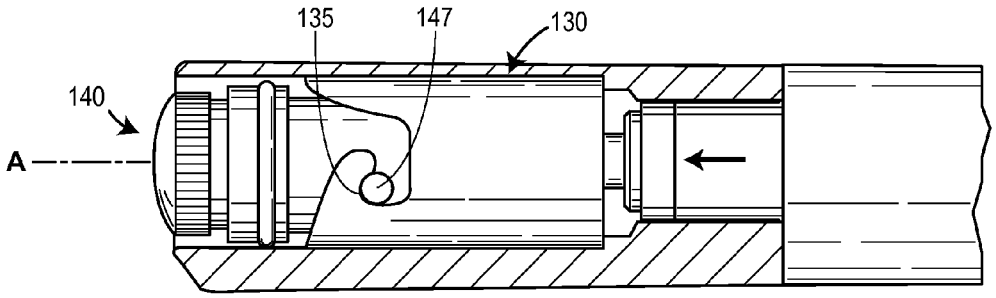
FIG. 11 is a close up view of the refill plug assembly of the writing instrument of FIG. 5 in a locked position with the barrel of the writing instrument being partially removed.

The sheath 152 may include a first sheath end 154, a second sheath end 156, and a through bore 158. A first sheath portion 160 may be operatively connected to the button 142 and a second sheath portion 164 may extend away from the button 142. The first sheath portion 160 may have an inner diameter that is larger than an inner diameter of the second sheath portion 164. An angled portion 166 may connect the first sheath portion 160 to the second sheath portion 164. The sheath 152 may include one or more bayonets or posts 147 that extend radially outward from an outer surface 149 of the sheath 152. In one embodiment, the posts 147 may be shaped as cylinders, as illustrated in FIG. 6. In other embodiments, the posts 147 may have other shapes, such as cubes or pyramids. Furthermore, the refill plug assembly 140 may include two posts 147, as illustrated in FIG. 6. In other embodiments, the refill plug assembly 140 may include one, three, four, five, six, or more posts 147.

The plunger 162 may be slidably attached to the second sheath portion 164. The plunger 162 may include a plunger body 168 having a first body end 170 and a second body end 172. At least a portion of the plunger body 168 may be disposed within the through bore 158 of the sheath 152. The plunger body 168 may be displaceable longitudinally within the through bore 158 substantially parallel to a longitudinal axis A of the sheath 152. The plunger 162 may be displaceable between a first extended position in which the first plunger end 170 is proximate the second sheath end 156 and a second retracted position in which the first plunger end 170 is proximate the second button end 146. In some embodiments, the through bore 158 and the plunger body 168 may be substantially cylindrical in shape. In other embodiments, the through bore 158 and the plunger body 168 may take on other shapes as long as the plunger body 168 has a shape that fits within the through bore 158. In preferred embodiments, the plunger body 168 has an outer shape that is complimentary to the inner shape of the through bore 158.

A retaining element 177 (FIG. 6) may be located proximate the second body end 172. The retaining element 177 may cooperate with the refill assembly 122 to releasably secure the plunger 162 to the refill assembly 122 to facilitate removal of the refill assembly 122 from the barrel 112. In one embodiment, the retaining element 177 may have the shape of an annular ring 179 attached to a hollow tube 181. The hollow tube 181 may be sized to fit within a blind bore 198 (FIG. 5) in the refill assembly 122. The hollow tube 181 and the blind bore 198 may form an interference fit that releasably retains the refill assembly 122 on the refill plug assembly 140.

A cam liner 130 (FIG. 7) may be disposed between the refill plug assembly 140 and the barrel 112. The cam liner 130 may include a cylindrical outer wall 131 that fits within the hollow bore 118 of the barrel 112. A cam channel 132 may be formed in the cylindrical outer wall 131. The cam channel 132 may include a first leg 133 oriented longitudinally, substantially parallel to the longitudinal axis A and a second leg 134 that is oriented circumferentially around a portion of the cylindrical outer wall 131. The second leg 134 may include a locking recess 135 that is oriented substantially longitudinally, similarly to the first leg 133. The locking recess 135 may be sized and shaped to receive a portion of the post 147.

Turning now to FIGS. 8-11, the posts 147 cooperate with the cam liner 130 to releasably retain the refill plug assembly 140 in the barrel 112. Initially, when securing the refill plug assembly 140 to the barrel 112, the posts 147 are aligned with the cam channel 132. As the refill plug assembly 140 is pushed towards the cam liner 130, the posts 147 travel into the first leg 133 of the cam channel 132. The refill plug assembly 140 travels longitudinally along axis A until the posts 147 reach the end of the first leg 133 of the cam channel 132. At this point, the posts 147 contact an edge of the cam channel 132, which prevents further longitudinal movement of the refill plug assembly 140 towards the cam liner 130. The refill plug assembly 140 is then rotated (preferably less than ¼ of a turn) and the posts 147 travel along the second leg 134 of the cam channel 132. Upon reaching an end of the second leg 134 (FIG. 10), the spring 192 (FIG. 5) biases the button 142 away from the cam liner 130, which forces the posts 147 to move into the locking recess 135, thereby securing the refill plug assembly 140 within the barrel 112.

In other embodiments, the bayonets or posts 147 may be formed on an inner surface of the cam liner 130 and the cam channel 132 may be formed on the outer surface 149 of the sheath 152. In yet other embodiments, the cam liner 130 may be integrally formed with the barrel 112.

Figure 12:
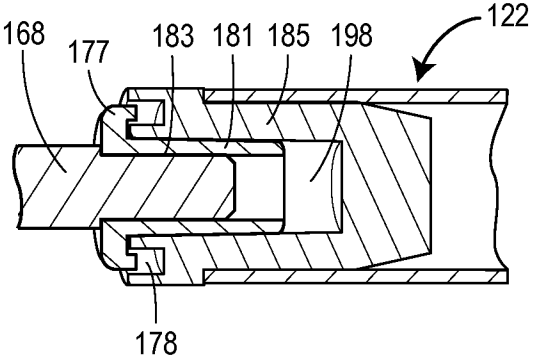
FIG. 12 is a close up cross-sectional view of a portion of the refill plug assembly and a portion of the refill assembly.
Figure 13:
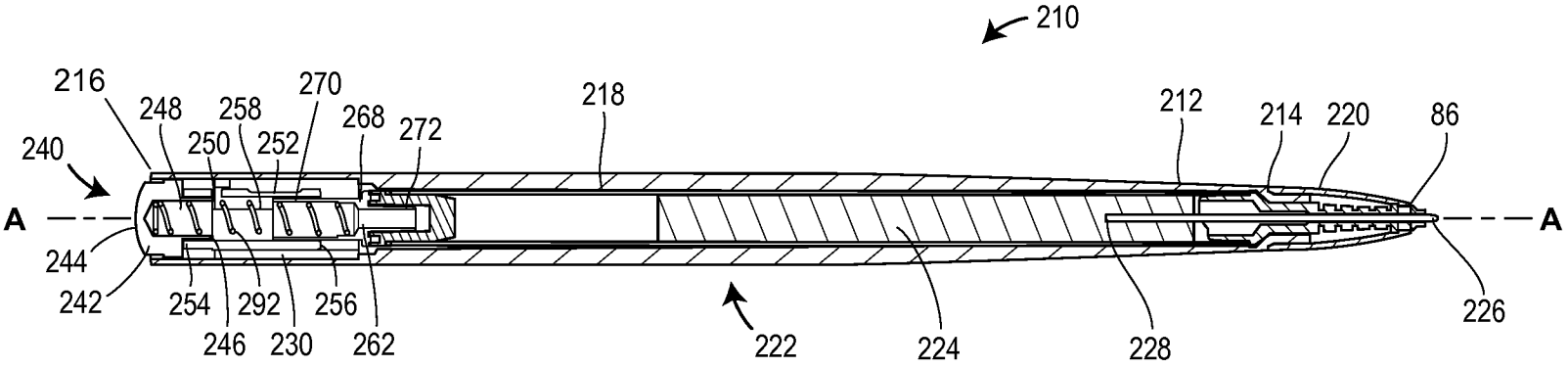
FIG. 13 is a longitudinal cross-sectional view of a writing instrument with yet another alternate embodiment of a refill plug assembly.
Figure 14:
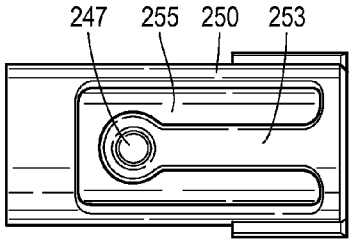
FIG. 14 is a side view of a sheath of the refill plug assembly of FIG. 13, the sheath having a flexible arm.
Figure 15:
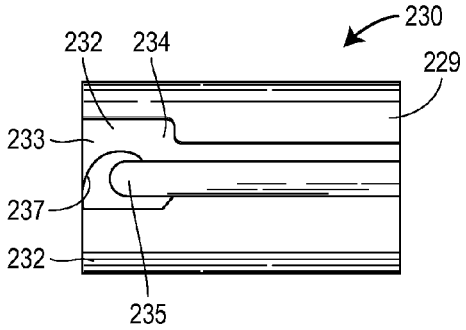
FIG. 15 is a side view of a cam liner of the refill plug assembly of FIG. 13.

Turning now to FIG. 12, the connection between the retaining element 177 and the refill assembly 122 is illustrated in greater detail. The hollow tube 181 forms an interference fit with the blind bore 198 in the refill assembly. The hollow tube 181 may include a central bore 183 sized to receive a portion of the plunger body 168 so that the plunger body 168 may compress into the blind bore 198 (at least partially) as the refill plug assembly 140 is secured to the refill assembly 122. In some embodiments the retaining element 177 may be made from an elastomeric material while an end cap 185 of the refill assembly 122 may be made from a thermoplastic material. The retaining element 177 may be soft enough to be squeezed into the blind bore 198 (and at least partially into the annular channel 178) to enhance the releasable connection between the refill plug assembly 140 and the refill assembly 122. In other embodiments, the end cap 185 may be made from polyethylene, polypropylene, silicone, aluminum, brass, stainless steel, or any combination thereof.

A third embodiment of a writing instrument 210 with a refill plug assembly is illustrated in FIGS. 13-17. Elements of the writing instrument 210 that are similar to the elements of the writing instruments 10 and 110 of FIGS. 1-12 are given similar reference numerals, but increased by 100 over the writing instrument 110 of FIGS. 5-12 and by 200 over the writing instrument 10 of FIGS. 1-4.

The writing instrument 210 illustrated in FIGS. 13-17 includes a barrel 212 having a first barrel end 214, a second barrel end 216, and a hollow central bore 218. A ferrule section 220 may extend from the first barrel end 214. In some embodiments, the ferrule section 220 and the barrel 212 may be separate components; in others, the ferrule section 220 may be integrally formed with the barrel 212.

A refill assembly 222 may be disposed within the hollow central bore 218. The refill assembly 222 may include an ink reservoir 224 that is fluidly connected to a writing point 226. In some embodiments, an ink feedstick 228 may be fluidly connected to both the ink reservoir 224 and to the writing point 226 to facilitate delivery of ink from the ink reservoir 224 to the writing point 226. The ink feedstick 228 may be an extruded feedstick or a fibrous feedstick, for example. Alternatively, the ink reservoir 224 can be fluidly connected to the writing point 226 via a lumen. In some embodiments the ink reservoir 224 may be a fibrous reservoir and in other embodiments the ink reservoir 124 may be a free ink reservoir.

A refill plug assembly 240 may be releasably secured to the barrel 212 at the second barrel end 216. The refill plug assembly 240 prevents the ink refill assembly 222 from unintentionally becoming dislodged from the hollow central bore 218 and maintains the ink refill assembly 222 in its proper position within the barrel 212. The refill plug assembly 240 may be quickly and easily removed to access the ink refill assembly 222. For example, the refill plug assembly 240 may be longitudinally moved along axis A to successively release and secure the refill plug assembly 240 from the barrel 212.

The refill plug assembly 240 may include a button 242, a sheath 252, and a plunger 262. The button 242 may have a first button end 244 and a second button end 246. The button 242 may also include a hollow bore 248 having an opening 250 proximate the second button end 246, similar to the embodiments of FIGS. 1-4 and FIGS. 5-12.

The sheath 252 may include a first sheath end 254, a second sheath end 256, and a through bore 258. The sheath may include a flexible arm 253 (FIG. 14) located between two legs of a channel 255. At a free end of the flexible arm 253, a protrusion or post 247 extends radially outward. The flexible arm 253 may be displaced laterally, generally perpendicular to the longitudinal axis A to allow the post 247 to move within a cam channel, as discussed below.

The plunger 262 may be slidably attached to the sheath 252. The plunger 262 may include a plunger body 268 having a first body end 270 and a second body end 272. At least a portion of the plunger body 268 may be disposed within the through bore 258 of the sheath 252. The plunger body 268 may be displaceable longitudinally within the through bore 258 substantially parallel to the longitudinal axis A. In some embodiments, the through bore 258 and the plunger body 268 may be substantially cylindrical in shape. In other embodiments, the through bore 258 and the plunger body 268 may take on other shapes as long as the plunger body 268 has a shape that fits within the through bore 258. In preferred embodiments, the plunger body 268 has an outer shape that is complimentary to the inner shape of the through bore 258.

The sheath 252 may be at least partially disposed within a hollow bore 229 (FIG. 15) of a cam liner 230. The cam liner 230 has a cam groove 232 formed on an inner surface thereof. In the embodiment illustrated in FIGS. 13-17, the cam groove 232 does not extend completely through the cam liner 230. In other embodiments the cam groove 232 may extend completely through the cam liner 230. The cam groove 232 includes a first leg 233 that extends substantially parallel to the longitudinal axis A and a second leg 234 that extends circumferentially, substantially perpendicularly to the longitudinal axis A. The second leg 234 also includes a locking recess 235 that is sized and shaped to receive at least a portion of the post 247.

Figure 16:
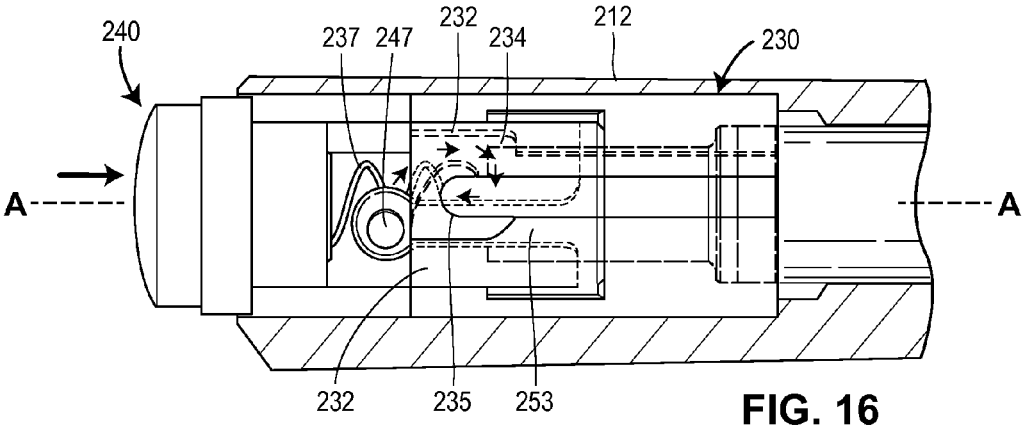
FIG. 16 is a side view of the refill plug assembly of FIG. 13 in an unlocked position with the barrel of the writing instrument being partially removed.
Figure 17:
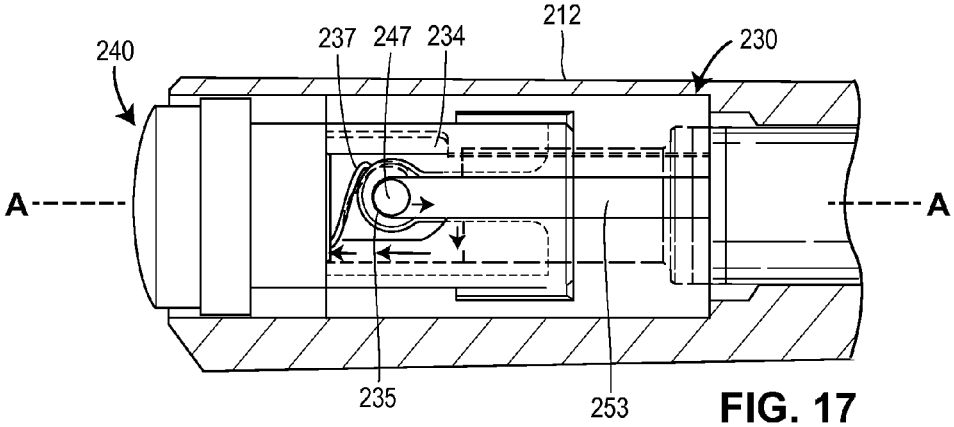
FIG. 17 is a side view of the refill plug assembly of FIG. 13 in a locked position with the barrel of the writing instrument being partially removed.

As illustrated in FIGS. 16 and 17, the posts 247 cooperate with the cam liner 230 to releasably retain the refill plug assembly 240 in the barrel 212. Initially, when securing the refill plug assembly 240 to the barrel 212, the posts 247 are aligned with the cam groove 232. As the refill plug assembly 240 is pushed towards the cam liner 230, a first cam surface 237 forces the posts 247 circumferentially into the first leg 233 of the cam groove 232. Once the posts 247 clear the first cam surface 237, the flexible arm 253 returns to a neutral position, where the flexible arm 253 is generally aligned with the longitudinal axis A, thereby bringing the posts 247 into the second leg 234 of the cam groove 232. The spring 292 (FIG. 13) biases the refill plug assembly 240 away from the cam liner 230, which causes the posts 247 to move into the locking recess 235.

To release the refill plug assembly 240, the refill plug assembly 240 is moved longitudinally, towards the cam liner 230. Once the posts 247 clear the locking recess 235, the button 242 may be rotated (preferably less than ¼ turn) until the posts 247 align with the cam groove 232. Thereafter, the spring 292 biases the refill plug assembly 240 away from the cam liner 230 and the refill plug assembly 240 and the refill assembly 222 may be removed from the barrel 212.

Elements of any of the disclosed embodiments may be combined with any of the other disclosed embodiments. For example, any of the various disclosed retaining elements may be used with any of the disclosed plungers. Similarly, any of the disclosed plungers may be used with any of the disclosed refill plug assemblies.

The disclosure is not limited to a writing instrument with an extruded plastic writing point. The disclosure could be applied to virtually any writing instrument, such as markers, ball point pens, fibrous pens, etc. The features of the invention disclosed in the description, drawings and claims can be individually or in various combinations for the implementation of the different embodiments of the invention.

The invention claimed is:

1. A refill plug assembly for a writing instrument, the refill plug assembly comprising:

a button having a button first end, a button second end, and a hollow bore, the hollow bore having an opening proximate the second button end;

a sheath operatively connected to the button, the sheath having a first sheath end, a second sheath end, and a through-bore; and a plunger slidably disposed within the through-bore of the sheath, wherein the plunger is displaceable between a first extended position in which a first plunger end is proximate the second sheath end and a second retracted position in which the first plunger end is proximate the button second end.

2. The refill plug assembly of claim 1, wherein the button and the sheath are formed as an integral unit.

3. The refill plug assembly of claim 1, further comprising a spring disposed at least partially within the hollow bore of the button and at least partially within the through-bore of the sheath, the spring biasing the plunger away from the button.

4. The refill plug assembly of claim 1, wherein the sheath includes a first portion having a first inner diameter and a second portion having a second inner diameter.

5. The refill plug assembly of claim 4, wherein the first portion is coupled to the button and the second portion is coupled to the plunger, the first inner diameter being larger than the second inner diameter.

6. The refill plug assembly of claim 1, wherein the sheath includes an inner annular flange disposed at the second end, the inner annular flange being capable of retaining the plunger within the sheath when the plunger is biased away from the button.

7. The refill plug assembly of claim 1, wherein the plunger includes an outer annular flange at a first plunger end, the outer annular flange being capable of retaining the plunger within the sheath when the plunger is biased away from the button.

8. The refill plug assembly of claim 1, wherein the plunger includes a retaining element at a second plunger end, the retaining element being adapted to be removably coupled to a refill for a writing instrument, thereby facilitating removal of the refill when the refill plug assembly is released from the writing instrument.

9. The refill plug assembly of claim 1, wherein one of a cam liner and the sheath includes at least one post.

10. The refill plug assembly of claim 9, wherein the sheath is at least partially disposed within the cam liner.

11. The refill plug assembly of claim 10, wherein the cam liner includes a cam channel that cooperates with the at least one post to releasably secure the sheath to the cam liner.

12. The refill plug assembly of claim 11, wherein the plunger includes a retaining element at a second plunger end, the retaining element being adapted to be removably coupled to a refill for a writing instrument, thereby facilitating removal of the refill when the refill plug assembly is released from the writing instrument.

13. The refill plug assembly of claim 9, wherein the at least one post extends radially outward from a free end of a flexible arm.

14. The refill plug assembly of claim 13 wherein the flexible arm is disposed between two legs of a channel.

15. The refill plug assembly of claim 14, wherein the flexible arm is movable laterally, substantially perpendicular to a longitudinal axis.

16. The refill plug assembly of claim 13, further comprising a cam liner, the sheath being at least partially disposed within the cam liner.

17. A writing instrument having a refill plug assembly, the writing instrument comprising:

a barrel having a hollow central bore;

a refill assembly including an ink reservoir that is fluidly connected to a writing point, the refill assembly being removably disposed within the hollow central bore of the barrel; and a refill plug assembly disposed at one end of the hollow central bore, the refill plug assembly including a button having a first button end, a second button end, and a hollow bore, the hollow bore having an opening proximate the second button end, a sheath operatively connected to the button, the sheath having a first sheath end, a second sheath end, and a through-bore, and a plunger slidably disposed within the through-bore of the sheath, wherein the plunger is displaceable between a first extended position in which a first plunger end is proximate the second sheath end and a second retracted position in which the first plunger end is proximate the button second end.

18. The writing instrument of claim 17, wherein the sheath includes external turn threads disposed on an outer surface proximate the first sheath end.

19. The writing instrument of claim 17, wherein one of a cam liner and the sheath includes at least one post.

20. The writing instrument of claim 17, wherein the at least one post extends outward from a free end of a flexible arm.

* * * * *